US005280839A

United States Patent [19]

Crampton

[11] Patent Number: 5,280,839

[45] Date of Patent: Jan. 25, 1994

[54] DISPLAYING AND STOCKING

[75] Inventor: Leslie Crampton, Mulgrave, Australia

[73] Assignee: Christina Investments Pty Ltd., Australia

[21] Appl. No.: 951,164

[22] Filed: Sep. 25, 1992

[30] Foreign Application Priority Data

Nov. 8, 1991 [AU] Australia ..... PK9352

[51] Int. Cl.[5] ..... A47F 5/00

[52] U.S. Cl. ..... 211/13; 211/163; 40/657

[58] Field of Search ..... 211/163, 13, 59.1; 40/657

[56] References Cited

U.S. PATENT DOCUMENTS

| | | | |
|---|---|---|---|
| 3,978,593 | 9/1976 | Pulitzer et al. | 211/59.1 X |
| 4,072,246 | 2/1978 | Paulin | 211/59.1 X |
| 4,253,576 | 3/1981 | Ford et al. | 211/59.1 X |
| 4,336,886 | 6/1982 | Azoulay et al. | 211/13 |
| 4,815,610 | 3/1989 | Borick et al. | 211/13 X |
| 4,832,607 | 5/1989 | Dorrell | 211/13 X |
| 4,976,532 | 12/1990 | Nyman | 211/59.1 X |
| 5,016,759 | 5/1991 | Spamer | 211/13 |

*Primary Examiner*—Robert W. Gibson, Jr.
*Attorney, Agent, or Firm*—Andrus, Sceales, Starke & Sawall

[57] ABSTRACT

A method of displaying and stocking three categories of an article which comprises:

supplying first, second and third categories of an article each having associated therewith respectively, first, second and third indicia having, respectively, first, second and third visual appearances, which visual appearances being different from one another; and mounting or arranging the articles in the first second and third categories on respectively, first, second and third regions of a display unit wherein said first, second and third regions have associated therewith first, second and third indicia substantially similar in appearance to said first, second and third visual appearances.

5 Claims, 3 Drawing Sheets

DISPLAYING AND STOCKING

FIELD OF THE INVENTION

This invention relates to displaying and also to stocking. Amongst other things, this invention relates to a display stand, mounts for articles to be displayed, article tickets, article containers, promotional sheets headers and other display, stocking and promotional material together with a display system and a stock system.

BACKGROUND TO THE INVENTION

Applicant has observed that a number of varieties of sunglasses are sold which have a shape and form such that they appeal in the following categories:

1. Mens
2. Ladies
3. Children
4. Sports and Unisex

However, such sunglasses are typically displayed on a vertical stand and may not be ordered on the stand with respect to the above categories.

Alternatively, even if the sunglasses are ordered on the stand with respect to the above categories the sunglasses may become disordered due to potential customers picking up sunglasses of one category and later replacing those sunglasses on the stand but amongst sunglasses of another category.

Further, storekeepers may themselves place sunglasses of one category amongst sunglasses of another category, such as when tidying the display stand or replenishing the display stand after sales have occurred.

In consequence of the above, display stands can become very disordered and this may result in frustration or annoyance to potential customers in that they may have difficulty in selecting a pair of sunglasses of the desired category or may not be able to readily view all sunglasses of a desired category and thus sales may be lost.

Storekeepers may also be frustrated or annoyed in consequence of being uncertain how many sunglasses or a particular category are currently on the display stand and being uncertain whether or not to order more stock and which stock and how much stock to order.

Further, a sunglasses manufacturer's representative may have similar frustrations and annoyances as does a storekeeper.

The above problems are not confined to sunglasses and will also occur with respect to categories of wool, fastenings, light globes, spices and other articles.

The present invention seeks to provide an at least partial solution to at least some of the above problems.

SUMMARY OF THE INVENTION

The present invention provides a method of displaying and stocking three categories of an article which comprises:

supplying first, second and third categories of an article each having associated therewith respectively, first, second and third indicia having, respectively, first, second and third visual appearances, said visual appearances being different from one another; and mounting or arranging the articles in the first second and third categories on respectively, first, second and third regions of a display unit wherein said first, second and third regions have associated therewith first, second and third indicia substantially similar in appearance to said first, second and third visual appearances.

PREFERRED FEATURES OF THE INVENTION

Preferably the first, second and third categories of articles are supplied each in a container having associated therewith respectively, first, second and third indicia substantially similar in appearance to said first, second and third appearances.

The containers of, respectively, the first, second and third categories may be packed, respectively, in first, second and third cartons having associated therewith respectively, first, second and third indicia substantially similar in visual appearance to said first, second and third visual appearances.

The indicia used in this invention may include one or more of colour, pattern or ornamentation. Of these colour is considered to be best.

Thus, it is preferred that each of said first, second and third regions is differently coloured or carries different colours and that a substantially similar colour is used in respect of the indicia carried by the articles, the containers and the cartons. Similarly, header cards and promotional material may be provided and may be similarly coloured.

The display unit may take various forms but presently it is preferred to be a prism having three sides, each of which sides act as a respective one of the first, second and third regions.

Each side may have receptacles for articles.

While the above has been set out in respect of three categories of article, the present invention may be applied to more than three categories of article.

The present invention also provides a display unit in accordance with the above.

The present invention also provides, in combination, the display unit and articles in accordance with the above.

BRIEF DESCRIPTION OF THE VIEWS OF THE DRAWINGS

The present invention will be further illustrated by way of example by reference to the accompanying drawings in which.

DETAILED DESCRIPTION WITH RESPECT TO THE DRAWINGS

Figure 1:
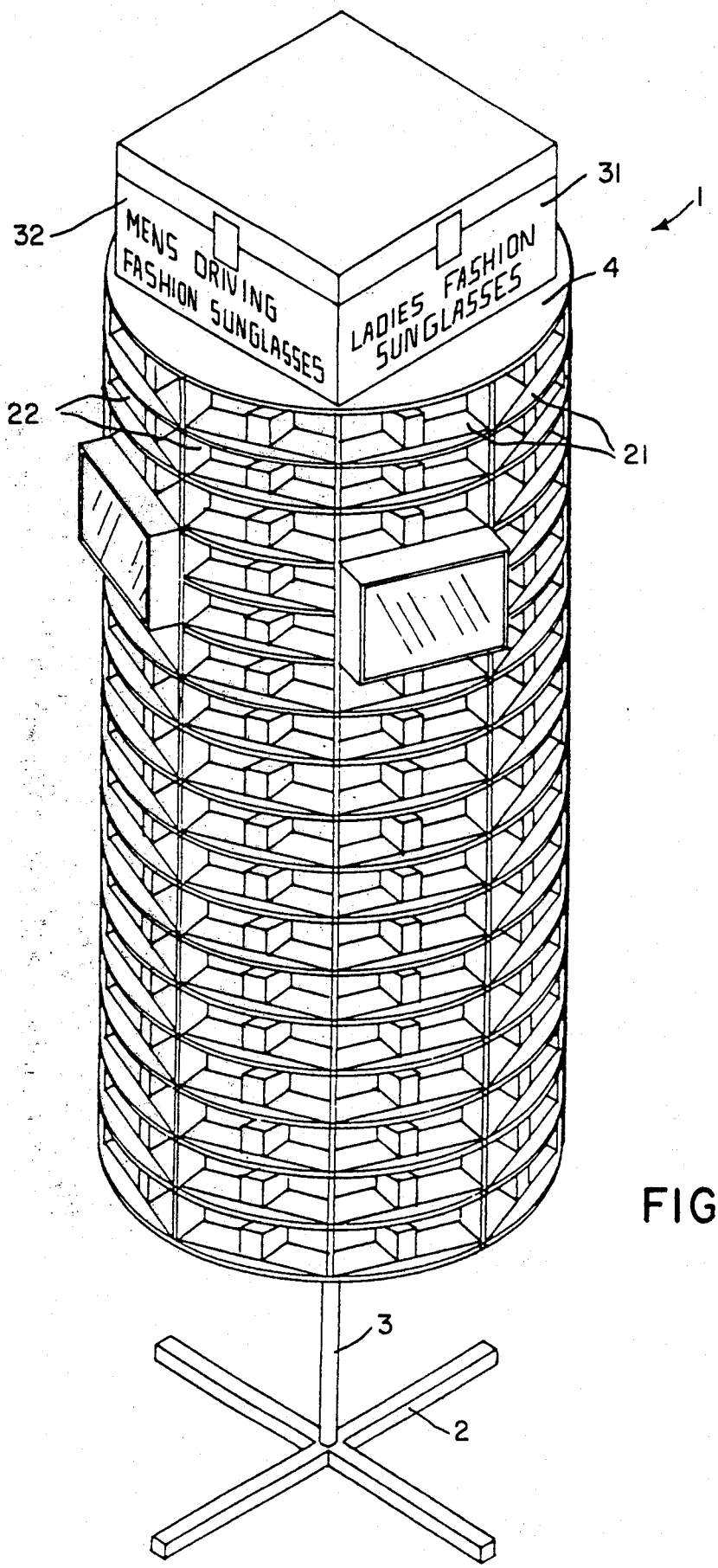
FIG. 1 is a perspective view from one side of a display stand.
Figure 2:
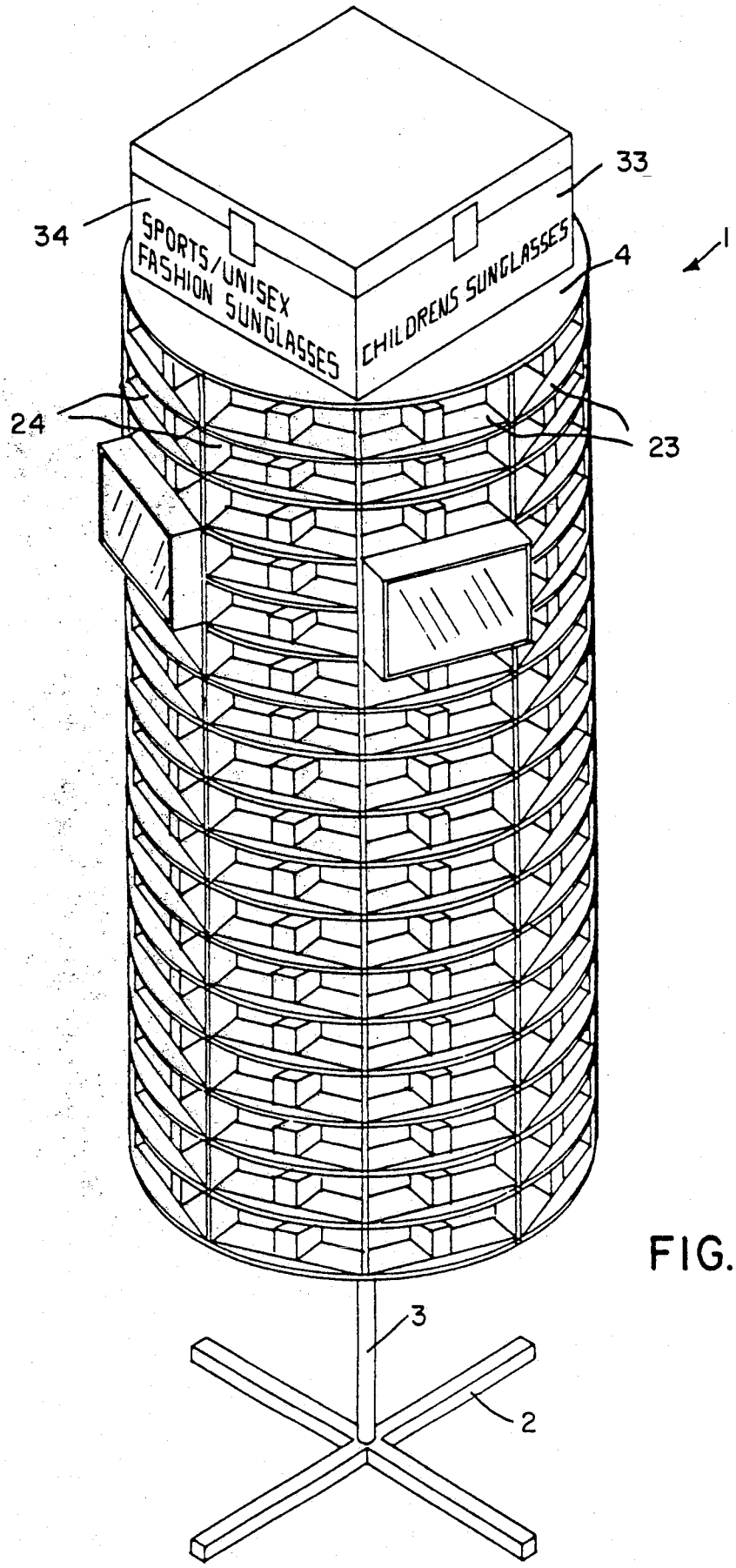
FIG. 2 is a perspective view from the other side of the display stand.
Figure 3:
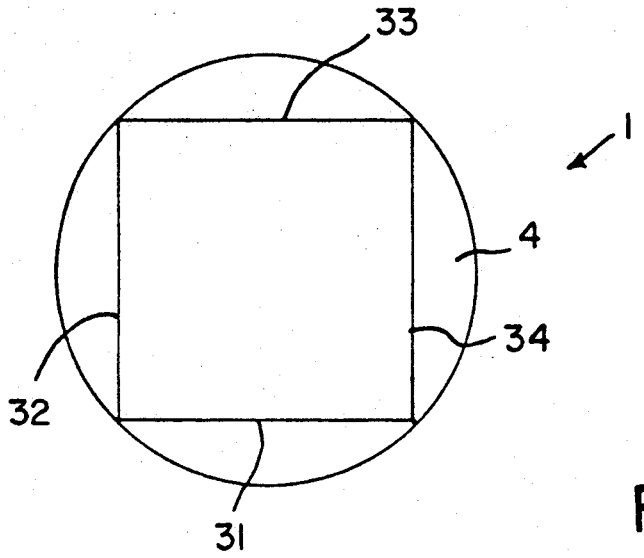
FIG. 3 is a top plan view of the display stand.

The display stand 1 shown in the drawings comprises a base 2, an upright tubular member 3 and top 4 and bottom (not shown) and white end plates mounted to the tubular member for rotation thereupon.

Between the end plates are mounted four individual sunglasses mounts 21, 22, 23 and 24. Those four mounts are respectively coloured, purple, blue, yellow and green to denote, respectively, sunglasses for ladies, mens or driving, children, and sports/uni-sex-teen.

In use, sunglasses are mounted to the mounts and it is to be noted that the sunglasses will have swing tickets which are purple, blue, yellow and green as is appropriate to sunglasses which are of the style ladies, mens or driving, children and a sports/uni-sex-teen.

Header cards, 31, 32, 33 and 34 are mounted on the top plate and are appropriately coloured purple, blue, yellow and green and are respectively located above the respective ones of the mounts 21, 22, 23 and 24.

The sunglasses were supplied in cardboard or other containers having substantial amounts of one of the colours purple, blue, yellow and green to denote the nature of the sunglasses in the container.

Figure 4:
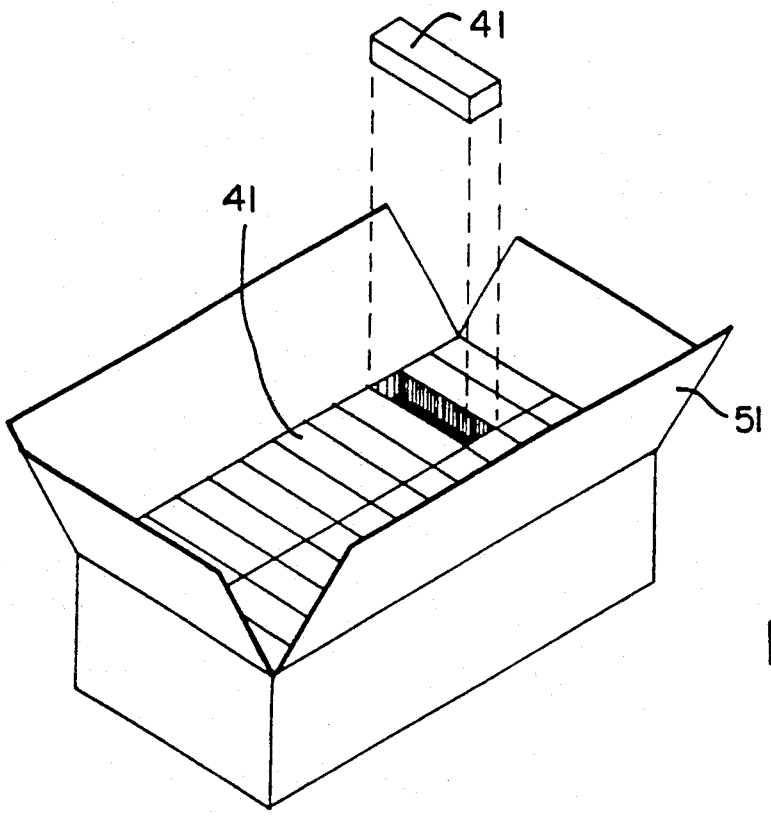
FIG. 4 is a perspective view of a carton and containers.

Typical containers, which have been marked 41, are shown in FIG. 4.

Similarly, the containers were packed in cartons having substantial amounts of one of the colours purple, blue, yellow and green to denote the nature of the sunglasses in the container.

A typical carton, which has been marked 51 is shown in FIG. 4.

White projection members may be provided beside the mounts 21, 22, 23 and 24 for holding neck cords for the sunglasses. Only some of the neck cords will be purple, blue, yellow or green as customer's tastes vary.

White boxes are preferably provided on the bottom plate and hold sunglasses cases which have draw cords in the colours purple, blue, yellow and green.

Hangers may hang from the boxes and carry additional neck cords.

In use, if a pair of sunglasses is mounted to an inappropriate mount this will be readily ascertainable as the colour of the swing ticket will not match the colour of the mount or the header card Thus the sunglasses can be noted and repositioned as appropriate.

Similarly, when stocks of one type of sunglasses is depleted it will be easy to know what stock to reorder.

Similarly, the colour coded containers and cartons will help in stock control and easy display.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit and ambit of the invention.

The drawings, claims and priority application, if any, form part of the disclosure of this Specification.

I claim:

1. A method of displaying and stocking three categories of an article which comprises:

supplying first, second and third categories of an article each having associated therewith respectively, first, second and third indicia having, respectively, first, second and third visual appearances, said visual appearances being different from one another; and mounting or arranging the articles in the first, second and third categories on respectively, first, second and third regions of a display unit wherein said first, second and third regions have associated therewith first, second and third indicia substantially similar in appearance to said first, second and third visual appearances; and wherein the first, second and third categories of articles are supplied each in a container having associated therewith respectively, first, second and third indicia substantially similar in appearance to said first, second and third appearances.

2. A method of displaying and stocking three categories of an article which comprises:

supplying first, second and third categories of an article each having associated therewith respectively, first and second and third indicia having, respectively, first, second and third visual appearances, said visual appearances being different from one another; and mounting or arranging the articles in the first, second and third categories on respectively, first, second and third regions of a display unit wherein said first, second and third regions have associated therewith first, second and third indicia substantially similar in appearance to said first, second and third visual appearances;

wherein the first, second and third categories of articles are supplied each in a container having associated therewith respectively, first, second and third indicia substantially similar in appearance to said first, second and third appearances; and wherein the containers of, respectively, the first, second and third categories are packed, respectively, in first, second and third cartons having associated therewith respectively, first, second and third indicia substantially similar in visual appearance to said first, second and third visual appearances.

3. A method of displaying and stocking as claimed in claim 1, wherein the indicia used is one or more of color pattern or ornamentation.

4. A method of displaying and stocking as claimed in claim 1, and further including that the display unit has three header cards each having first, second and third indicia substantially similar in appearance to said first, second and third visual appearances.

5. A method of displaying and stocking as claimed in claim 1, wherein the display unit is prismatic in form and has three sides which in use, act as respective ones of the first, second and third regions.

* * * * *